US006566822B2

(12) United States Patent
Schadhauser et al.

(10) Patent No.: US 6,566,822 B2
(45) Date of Patent: May 20, 2003

(54) ELECTRONIC CIRCUITS FOR DETECTING FILAMENT BREAKAGE IN GAS DISCHARGE LAMPS

(75) Inventors: Klaus Schadhauser, Munich (DE); Harald Schmitt, Munich (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/945,725

(22) Filed: Sep. 5, 2001

(65) Prior Publication Data

US 2002/0047604 A1 Apr. 25, 2002

(30) Foreign Application Priority Data

Sep. 18, 2000 (DE) ..... 100 46 443

(51) Int. Cl.[7] ..... H05B 37/02

(52) U.S. Cl. ..... 315/224; 315/225; 315/241 R; 315/227 R; 315/DIG. 7

(58) Field of Search ..... 315/209 R, 225, 315/224, 244, 241 R, 106, 121, 227 R, 246, 127, DIG. 2, DIG. 7

(56) References Cited

U.S. PATENT DOCUMENTS 4,710,682 A * 12/1987 Zuchtriegel ..... 315/127
4,949,013 A 8/1990 Zuchtriegel ..... 315/106
5,027,034 A 6/1991 Ruby et al. ..... 315/106
5,493,180 A * 2/1996 Bezdon et al. ..... 315/106
5,493,181 A 2/1996 Shackle et al. ..... 315/241 R
5,610,479 A * 3/1997 Schmitt ..... 315/209 R
5,612,597 A * 3/1997 Wood ..... 315/209 R
5,883,472 A 3/1999 Raiser ..... 315/225
5,952,790 A * 9/1999 Nerone et al. ..... 315/209 R
6,011,358 A * 1/2000 Knobloch et al. ..... 315/224
6,147,459 A * 11/2000 Knobloch et al. ..... 315/223

FOREIGN PATENT DOCUMENTS

EP 3805510 * 8/1989
EP 0422594 * 12/1994
EP 0809923 * 8/1999

* cited by examiner

*Primary Examiner*—Haissa Philogene
(74) *Attorney, Agent, or Firm*—Carlo S. Bessone

(57) ABSTRACT

Disconnection device for an electronic operating device for gas discharge lamps. The DC component is evaluated at a coupling capacitor (C5) specifically via a filament. Disconnection is performed in the event of filament breakage. In addition, the AC component of the generator output (O) can be monitored via a second filament, and disconnection can therefore also be performed in the event of breakage of the second filament.

9 Claims, 3 Drawing Sheets

ELECTRONIC CIRCUITS FOR DETECTING FILAMENT BREAKAGE IN GAS DISCHARGE LAMPS

TECHNICAL FIELD

The invention relates to a circuit arrangement for operating one or more low-pressure discharge lamps. In particular, this is a circuit which detects breakage of a filament of a lamp and puts the circuit arrangement into a safe mode.

PRIOR ART

The service life of a low-pressure discharge lamp fitted with filaments is determined chiefly by the service life of the filaments. If the filaments are consumed, there is firstly an increase in lamp voltage in association with an undesired temperature increase in the filament region of the lamp. The lamp mostly also exhibits a rectifying effect in this stage. Finally, the filament breaks, and this can lead to destruction of the lamp operating device and to dangerous overheating of the lamp ends. Some disconnection devices are known for safe operation of the lamp and protection of the operating device:

The lamp voltage is frequently used in order to obtain a criterion for disconnecting the operating device, (for example, EP 0 809 923). However, even in normal operation, the lamp voltage is subject to strong fluctuations, and so it is impossible in many cases to specify a unique threshold at which disconnection is to be undertaken. The operating device mostly includes what is termed a coupling capacitor, which absorbs the direct component of the output voltage of the AC voltage generator included in the operating device. The voltage across the coupling capacitor is used in U.S. Pat. No. 5,493,181 to detect the abovementioned rectifying effect of the lamp. It is necessary in this case to arrive at a quantitative statement on the value of this voltage and compare it with a threshold. It is also valid here that the value of the voltage to be measured is subject in normal operation to strong fluctuations, and so it is frequently impossible to specify a unique threshold. Reliable disconnection is therefore impossible in many cases, or very complicated technically.

It has also emerged that monitoring the filaments with regard to breakage suffices in order to be able to ensure reliable operation of the system of lamp and operating device. In known solutions, it is detected whether a DC test current can flow through the filaments to be tested (DE 3805510). The disadvantage of this method is that the test current flows in addition to the current required for normal operation, and thus constitutes an additional load for the filaments.

During dimmed operation, in particular, the filaments are subjected to an additional heating current, over and above the current for the gas discharge. There are solutions for detection of filament breakage which monitor the presence of the additional heating current (EP 0 422 594). However, the additional heating current is frequently very small compared with the current for the gas discharge for which reason detection is complicated and unreliable.

SUMMARY OF THE INVENTION

It is the object of the present invention to provide a disconnection device for an operating device which accomplishes reliable disconnection of the operating device in the event of breakage of a filament, doing so with a low outlay.

This object is achieved in the case of a device having the features of the preamble of claim 1 by means of the features of the characterizing part of claim 1. Particularly advantageous refinements are to be found in the dependent claims.

Many operating devices for gas discharge lamps contain an AC voltage generator which outputs at its output a voltage which has a direct component. A half-bridge circuit which includes two controlled switches connected in series can be used to implement the AC voltage generator. However, it is mostly lamps which ought not to conduct direct current which are operated with the aid of these operating devices. Consequently, in addition to other components, the lamp is connected as a rule to the AC voltage generator via what is termed a coupling capacitor. It is important for the disconnection of the operating device according to the invention that the current for the gas discharge of the lamp is fed at only one end of a filament. The coupling capacitor absorbs the DC voltage component of the AC voltage source. This DC voltage component can be filtered out via an averaging unit for the purpose of disconnecting the operating device in accordance with the invention. A simple design of the averaging unit is a first-order low pass filter which, in the simplest case, comprises only a resistor and a capacitor. The DC voltage component of the coupling capacitor is now fed to a circuit part (denoted by SD below) which is responsible for the disconnection and has a threshold characteristic at its input. It is important that this feeding takes place via a filament. In the event of filament breakage, the DC voltage component of the coupling capacitor is absent at the input of the circuit part SD. The threshold characteristic at the input of the circuit part SD need only be capable of detecting the DC voltage component of the coupling capacitor. This can be implemented very reliably without great outlay. However, it is to be noted that apart from the direct component of the coupling capacitor no further DC voltage component is fed to the input of the circuit part SD.

The threshold characteristic can be implemented by a transistor. If a voltage is present at its input, it prevents charging of a capacitor (denoted below by C7) which is connected, for example, via its output terminals. If, in the event of filament breakage, there is no input voltage, the capacitor C7 is charged up and triggers disconnection of the operating device. The capacitor C7 is discharged when the operating device is taken into use. It thereby prevents an undesired disconnection during the starting operation of the lamp. The value of the capacitance of the capacitor C7 must be selected so large that disconnection can be triggered only after the DC voltage component at the coupling capacitor has stabilized in event of an intact lamp. If the DC voltage component is established, this is also an indication that the lamp has started properly. The DC voltage component at the coupling capacitor can therefore also be used to detect "lamp burning".

The disconnection of the operating device can be performed by a further controlled switch. When the further switch is triggered, the above-named AC voltage generator is turned off. This can be performed in various ways. Mostly, an auxiliary voltage is required to generate trigger signals in the AC voltage generator. With the aid of said further switch, the auxiliary voltage of the AC voltage generator can be suppressed, thereby achieving disconnection of the operating device. Some AC voltage generators have a separate input at which a signal must be present in order to disconnect the output signal of the AC voltage generator for safety purposes (safety disconnection signal). This safety disconnection signal can also be suppressed with the aid of said further switch for the purpose of disconnection.

The above-described circuit arrangement according to the invention for detecting filament breakage is suitable first and foremost for only one filament or for filaments of a plurality of lamps which are connected in parallel and are all at the same potential. If, additionally, filaments are to be monitored which are at a different potential, this can be done in a different way including using methods which are already known from the prior art. In order to be able to ensure absolutely safe operation of a lamp, it is necessary to monitor all the filaments, since it cannot be foreseen which filament will break first. Since the filaments belonging to a lamp are at very different potentials, particularly in the case of starting, it is not possible, as a rule, to apply cost-effective implementations of the filament monitoring to all the filaments simultaneously. In this context, filament monitoring according to the invention permits combination with other monitoring methods. Thus, for example, filaments which are not monitored according to the invention by detecting the DC voltage component at the coupling capacitor can be monitored in a different way. If the AC voltage generator requires an auxiliary voltage, this can be conducted via the filaments which have not as yet been monitored. In the event of breakage of these filaments, feeding of the auxiliary voltage is interrupted and the AC voltage generator is disconnected.

A further possibility for monitoring filaments not monitored so far consists in detecting the AC voltage components at a lamp terminal. As in the case of the detection of the DC voltage component, the current for the gas discharge of the lamp is fed only at one end of the filament to be detected. The AC voltage present at the other end of this filament is coupled out via a capacitor. If the filament breaks, the amplitude of the coupled-out AC voltage is substantially reduced. This can be utilized according to the invention in order to permit the capacitor C7 to be charged to a value which, as described above, leads to disconnection of the operating device. This is preferably performed by disturbing the discharge of the capacitor C7 by means of a further controlled switch.

In addition, the following requirement is frequently placed on the disconnection of an operating device: if the lamp is changed after completed disconnection, the aim thereby is to reverse the disconnection and permit operation of the new lamp. This is accomplished according to the invention by virtue of the fact that the charging current of the capacitor C7 is conducted via one or more filaments. If the lamp is removed, the capacitor C7 is discharged. If the voltage across the capacitor C7 undershoots a prescribed value, the disconnection is reversed.

Implementing this inventive idea requires a distinction to be made between AC voltage generators which are externally excited and those which are self-excited. Externally excited AC voltage generators have for the purpose of triggering the circuit breaker an oscillator which requires an auxiliary voltage. In order to detect breakage of a filament in a way not performed by detecting DC voltage across the coupling capacitor, it is possible, as described above, for said auxiliary voltage to be conducted via the filament to be checked. The charging of the capacitor C7, whose voltage is used for the disconnection, can also be performed via the same filament. Firstly, in the event of breakage of this filament, the oscillator is turned off, and thus the operating device is disconnected; secondly, in the event of a change of lamp, charging of the capacitor C7 is interrupted and the disconnection is thereby reversed.

Self-excited operating devices do not have a separate oscillator. The trigger signal for the circuit breaker is obtained from the load circuit. Consequently, there is no possibility of disconnecting the oscillator by means of interrupting the auxiliary voltage in the event of filament breakage. According to the invention, in this case, in the event of breakage of the filament which is not being monitored by the DC voltage level across the coupling capacitor, disconnection can be performed by means of the above-explained detection of the AC voltage component. However, this filament should not then bear the charging current of the capacitor C7 on its own. The breakage of the filament would then certainly be detected, but the subsequent charging of the capacitor C7 would be interrupted, for which reason no disconnection would come about. Consequently, according to the invention, both lamp filaments are used in order to provide the charging current for the capacitor C7. Irrespective of which filament breaks, it is therefore ensured that a charging current which leads to disconnection is provided for C7. This AND operation of the filament currents is achieved by virtue of the fact that the lamp terminals which are not fed by the AC voltage generator are connected in each case to the capacitor C7 via a diode.

In this context, it is necessary to mention another aspect of the operating device with self-excited AC voltage generator. In particular, in the case of the AC voltage generator with a half bridge, importance attaches as to which state of charge the capacitors have on the occasion when the circuit breaker is first closed. The capacitors must be charged such that this first closing of a circuit breaker effects a flow of current which brings about the self-excitation of the AC voltage generator. The charge relationships of the capacitors can be displaced before starting the AC voltage generator by means of the two said diodes for AND operation. If appropriate, it is necessary to modify the starting circuit whose task is to close one of the two half-bridge switches once. This modification can be such that it is no longer the lower half-bridge switch, but the upper half-bridge switch which is first closed.

BRIEF DESCRIPTION OF THE DRAWINGS

The aim below is to explain the invention in more detail with the aid of a plurality of exemplary embodiments. In the drawing.

DETAILED DESCRIPTION OF THE INVENTION

Capacitors are denoted below by the letter C, resistors by R, inductors by L, transistors by T and diodes by D, followed by a number in each case.

Figure 1:
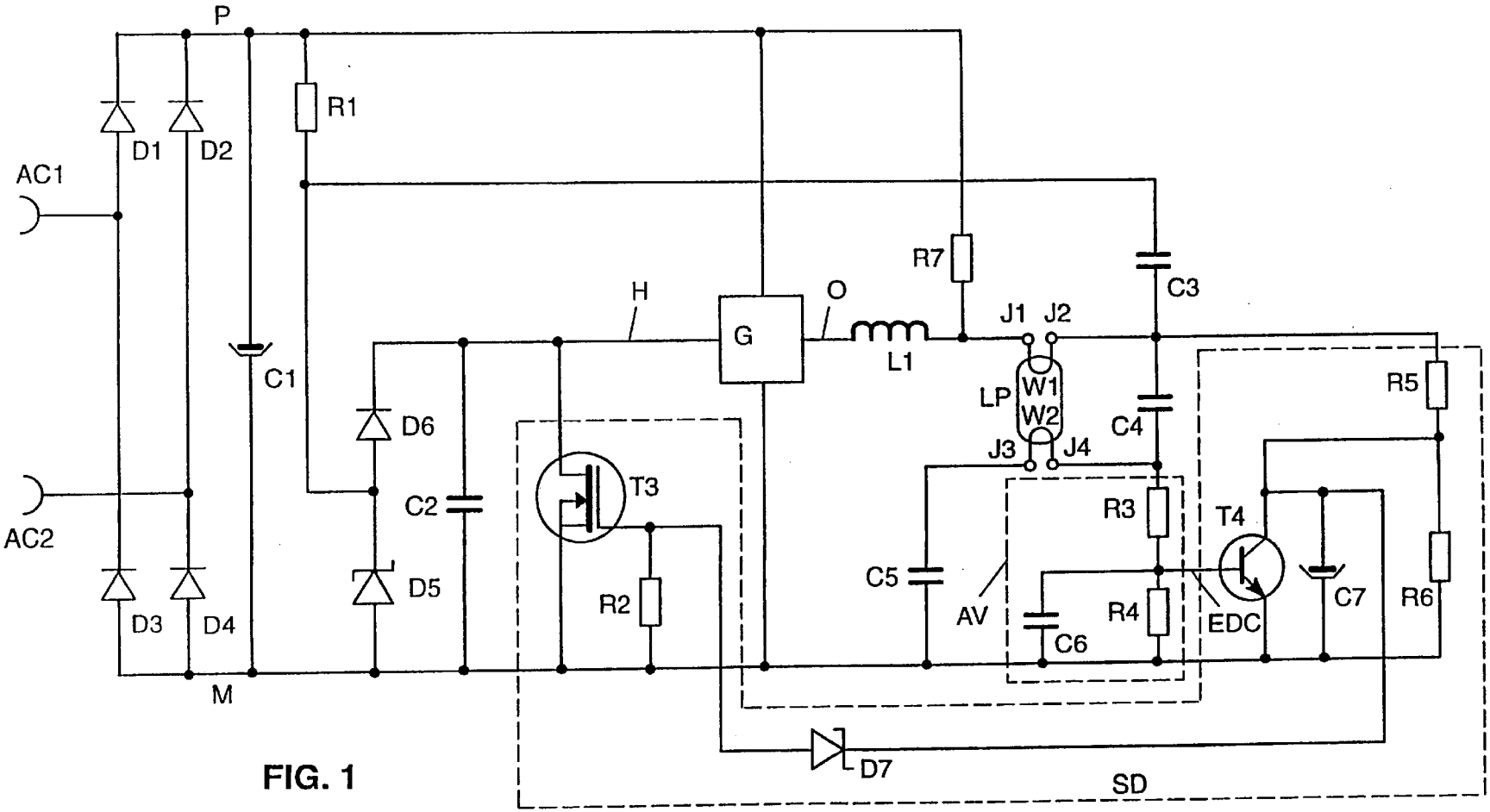
FIG. 1 shows a circuit diagram of an operating device for a gas discharge lamp with disconnection according to the invention in the event of breakage of one of the two filaments, with an externally excited AC voltage generator.

The operating device in FIG. 1 is designed for operating on an AC voltage network. The system voltage of, for example, 230 Veff is connected to the terminals AC1 and AC2. D1, D2, D3 and D4 form a full-wave rectifier which makes available at its outputs P (positive) and M (frame) a DC voltage which is termed supply voltage below. The capacitor C1 is connected between P and M in order to smooth the supply voltage. An AC voltage generator G draws its energy via P and M. The AC voltage generator G makes available at the output O an AC voltage with a direct component for operating a gas discharge lamp. The AC voltage generator G requires an auxiliary voltage H. The auxiliary voltage H is derived directly from the supply voltage via R1 only for starting purposes. For operation the auxiliary voltage H is generated via C3, which is connected at the terminal J2 of the filament W1. D5, D6 and C2 serve to rectify and stabilize the AC voltage fed in via C3. The lamp inductor L1 connects the output O of the AC voltage generator G to the lamp filament W1 at the terminal J1. The circuit for the gas discharge current through the lamp Lp is connected to frame M by the filament W2 at the terminal J3 via the coupling capacitor C5. On the side of the lamp not connected to the AC voltage generator G, the resonance capacitor C4 is connected to the filament W1 at the terminal J2 and to the filament W2 at the terminal J4.

A circuit part SD including the following components serves the purpose of disconnection: T3, R2, D7, T4, C7, R5 and R6. The base of T4 is connected to the input EDC of SD. The emitter of T4 is connected to frame M. C7 is connected between the emitter and collector of T4. The voltage at the collector of T4 is fed to the gate of T3 via a Zener diode D7. D7 points with the cathode to T4. T3 is connected with the source to frame M. The gate of T3 is connected to frame M via R2. The drain of T3 is connected to the auxiliary voltage terminal H of the AC voltage generator G. R5 and R6 form a voltage divider. The voltage divider is connected to frame M at the end of R6. The collector of T4 is connected at the connecting point of R5 and R6 and therefore so is C7. The charging current for C7 is fed into the end of R5 of the voltage divider. This is performed via the filament W1 and R7 from the positive pole P of the supply voltage. In normal operation, the potential at the input EDC of SD is so large (>0.7 V) that T4 is in the conducting state. Consequently, C7 remains discharged and the potential at the collector of T4 is so low that the Zener diode does not conduct in the reverse direction. If the potential of EDC drops so far (<0.7 V) that T4 goes over into the blocking state, C7 is charged via R7, the filament W1 and R5. As soon as the voltage across C7 is so high that D7 starts to conduct in the reverse direction, T3 is triggered and goes over into the conducting state. This short-circuits the auxiliary voltage H of the AC voltage generator G, and thereby disconnects the operating device.

The input EDC of SD is controlled from the connecting point of R3 and R4. The other terminal of R4 is connected to frame M and the other terminal of R3 is connected to the terminal J4 of the filament W2. C6 is connected in parallel with R4. This circuit arrangement comprising R3, R4 and C6 acts as a low pass filter. The DC voltage component of the voltage present at C5 is therefore conducted via the filament W2 to the input EDC of SD. Consequently, in normal operation the potential at the input EDC is so high that the operating device is not disconnected. If the filament W2 breaks, there is no longer a DC voltage at the terminal J4 of the filament W2, the potential at the input EDC drops below the threshold at which T4 is still in the conducting state, and the operating device is disconnected. In the case of a change of lamp, the charging current of C7 is interrupted because of the lack of the filament W1. The potential at the collector of T4 drops, T3 blocks and the AC voltage generator is resupplied with the required auxiliary voltage (H) for restarting purposes.

In the event of a breakage of the filament W1, the auxiliary voltage H required to operate the AC voltage generator G and fed via C3 is interrupted, and the operating device is thereby disconnected.

Figure 2:
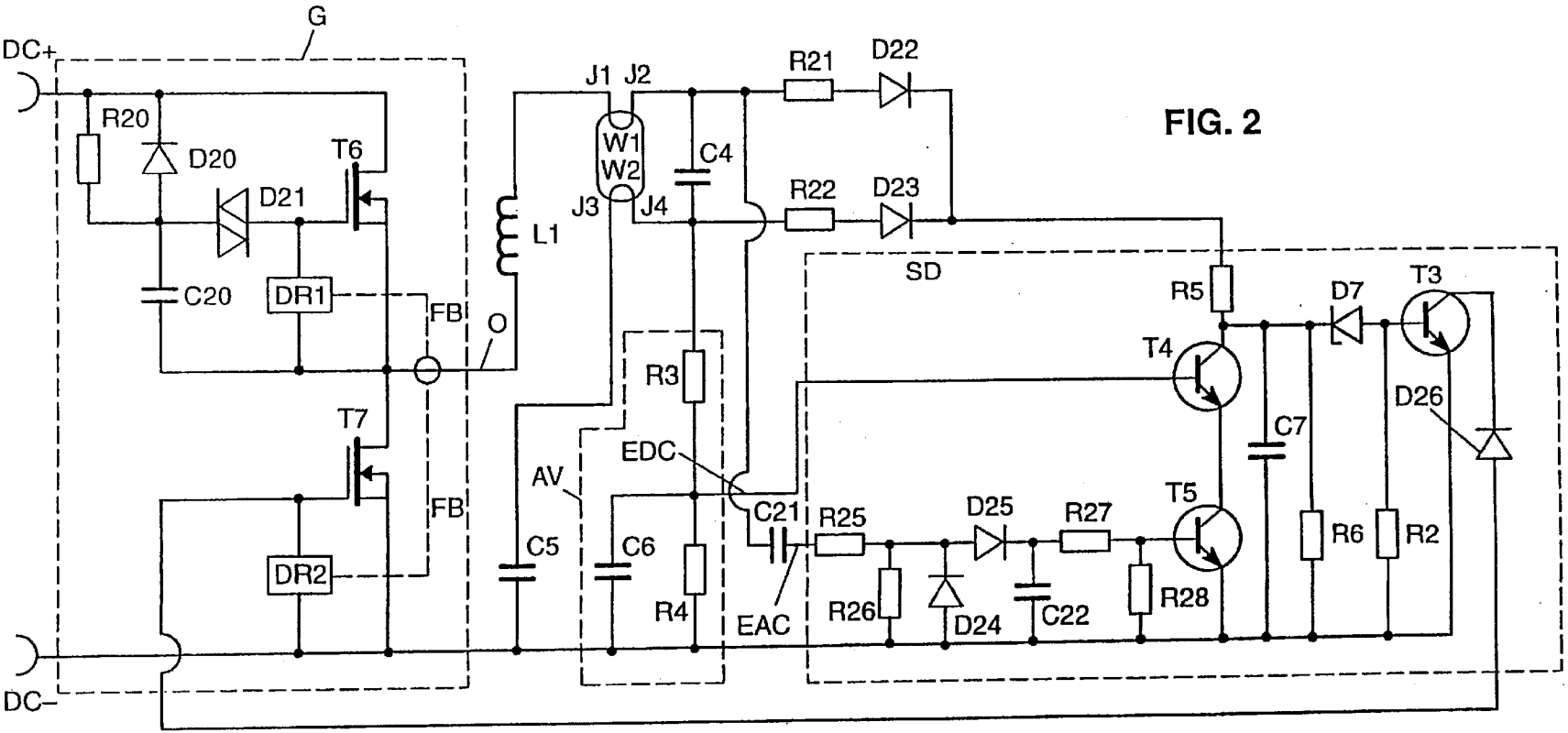
FIG. 2 shows a circuit diagram of an operating device for a gas discharge lamp with disconnection according to the invention in the event of breakage of one of the two filaments, along with a self-excited AC voltage generator.

FIG. 2 shows an exemplary embodiment of the disconnection according to the invention by means of detecting filament breakage in the case of an operating device with a self-excited AC voltage generator G. The device is supplied with a DC voltage via the terminals DC+ and DC−. This corresponds to the supply voltage of FIG. 1. The series circuit of two semiconductor switches T6 and T7, which are designed here as MOSFETs, is connected between DC+ and DC−. The connecting point between transistors forms the output O of the half bridges implemented by the semiconductor switches T6 and T7. The load current led off at the output O is detected by a feedback arrangement FB and fed respectively to a trigger circuit DR1 and DR2 for the semiconductor switches T6 and T7. The trigger circuits DR1 and DR2 are respectively connected between the gate and source of the semiconductor switches T6 and T7, and alternately effect closing and opening of these semiconductor switches, as a result of which an AC voltage affected with reference to DC− by a DC voltage component is present at the output O of the half bridge. The circuit elements R20, D20, D21 and C20 serve the purpose of starting the half-bridge oscillation for the first time. The series circuit of R20 and D20 is connected between DC+ and the half-bridge output O. The diac D21 is connected to the connecting point. The other end of the diac D21 is connected to the gate of the upper half-bridge transistor T6. C20 is charged via R20 when the device is started. If the voltage across C20 exceeds the trigger voltage of the diac D21, the upper half-bridge transistor T6 is triggered and the oscillation of the half bridges is started. Discharging of C20 during operation is ensured via D20.

The circuit elements L1, C4, C5, C6, C7, J1, J2, R2, R3, R4, R6 and D7 are connected identically to those in FIG. 1. By comparison with FIG. 1, T3 is designed as a bipolar transistor. The collector of T3 is connected to the gate of the lower half-bridge transistor (T7) via the diode D26. If T3 is triggered, a current which suppresses the triggering of T7 flows via D26. The resistor R5 is not, as in FIG. 1, connected directly to the terminal J2 of the filament W1. Rather, it is connected both to J2 and to the terminal J4 of the filament W2 with the aid in each case of a series circuit of a resistor and a diode (R21, D22, R22, D23). The above-described AND operation of the charging current of C7 is implemented thereby.

The AC voltage input EAC of the circuit part SD is also connected to J2 via C21. C21 conducts only the AC voltage component of the potential at J2 to EAC. Downstream thereof is a voltage divider composed of the resistors R25 and R26 between EAC and DC−. The anode of D25 and the cathode of D24 is connected to the connecting point of R25 and R26. The anode of D24 is at the low potential of the supply voltage (DC−) and is required in order to evaluate the negative component of the AC voltage at EAC. The cathode of D25 is connected to the capacitor C22. The other terminal of C22 is at the low potential of the supply voltage (DC−) and C22 serves to integrate the AC voltage rectified by D24 and D25 and present at EAC. The voltage present at C22 is fed to a voltage divider, formed from the resistors R27 and R28. The connecting point of R27 and R28 is connected to the base of transistor T5. Otherwise than in FIG. 1, in FIG. 2, the emitter of transistor T4 is not connected to the low potential of the supply voltage (DC−) directly but via the collector-emitter path of T5. In the event of the absence of an AC voltage at EAC, T5 and thus also T4 are no longer triggered, as a result of which C7 can be charged and disconnection is triggered.

Figure 3:
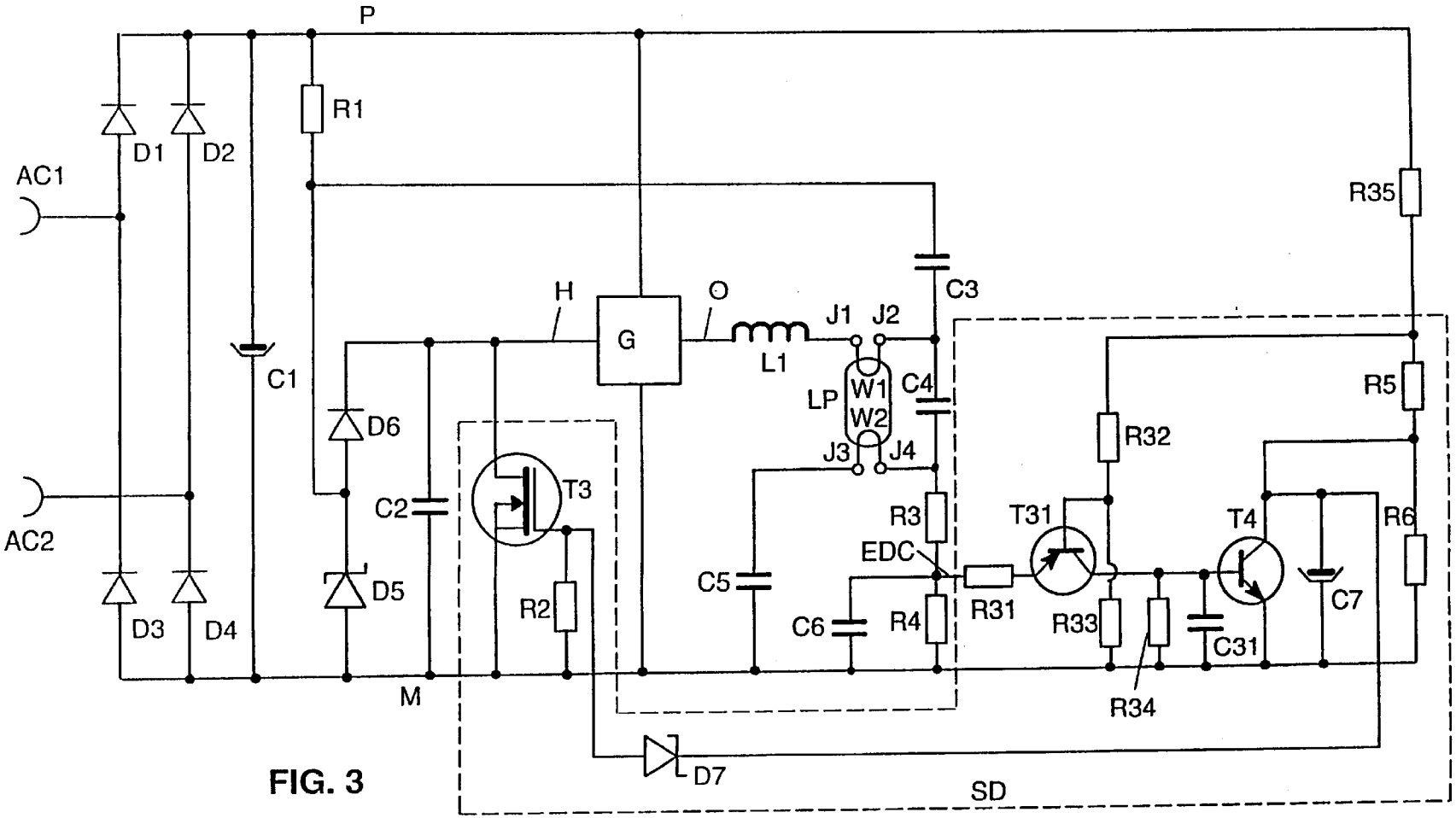
FIG. 3 shows a circuit diagram of an operating device for a gas discharge lamp with disconnection according to the invention in the event of breakage of one of the two filaments, along with an externally excited AC voltage generator, and an increased interference immunity.

A variant of the circuit diagram of FIG. 1 is illustrated in FIG. 3. The signal from the coupling capacitor C5 is occasionally subjected to substantial interference. The cause of this interference is frequently the sporadic contact which a filament already broken per se keeps remaking. This interference is counteracted by the extension in FIG. 3 with reference to FIG. 1. The connection between the capacitor for averaging C6 and the base of T4 is no longer direct, but via the series circuit of R31 and the emitter-collector path of the transistor T31. The collector of T31 is connected to the base of T4 and, for the purpose of further suppression of interference, to frame (M) via the parallel circuit of R34 and C31. The base of T31 is connected to frame (M) via R33 and to the positive pole (P) via R32 and R35. This circuit is used to evaluate only signals at the coupling capacitor C5 which, with reference to the voltage at the positive pole (P), exceed a value set by the resistance values R3, R4, R5, R6, R32, R33, R35. If it is not desired for the evaluated signals to be a function of the voltage at the positive pole (P), a Zener diode between C6 and the base of T4 also suffices instead of the transistor T31.

A further variation in FIG. 3 with reference to FIG. 1 is the terminal of R5. It is not, as in FIG. 1, connected to the terminal J2 of the filament W1, but to the positive pole (P), via R35. As a result, the disconnection is not reversed upon exchange of the lamp, but only in the event of a system interruption.

What is claimed is:

1. An electronic operating device for operating one or more gas discharge lamps which contain filaments, the operating device comprising:

a first circuit part (SD) which employs a signal at its input (EDC) to the effect that in the event of overshooting or undershooting of prescribed thresholds over the prescribed period the operating device is put into a safe state which is intended to prevent overloading of the operating device and/or overheating of the lamps and/or putting people at risk of electric shock, said first circuit part (SD) includes a controlled switch (T4) which permits a capacitor (C7) to be charged upon undershooting of a voltage threshold at its control electrode and, upon overshooting of the voltage across this capacitor (C7) beyond a prescribed value, this operating device is put into a safe state, an AC voltage generator (G), which outputs at its output (O) an AC voltage which has a DC voltage component, and a load circuit which includes at least one capacitor (C5) which at least partially absorbs said DC voltage component, wherein, the voltage across said capacitor (C5) is fed to said input (EDC) of the first circuit part (SD), specifically via at least one filament and via a second circuit part (AV) which supplies a signal which corresponds at least approximately to the mean value of the voltage across said capacitor (C5), said input (EDC) of the first circuit part (SD) having, apart from via the lamp, no electrical connection to the output (O) of the AC voltage generator (G).

2. The operating device as claimed in claim 1, wherein the AC voltage generator includes a half-bridge circuit with two controlled switches (T6, T7) connected in series.

3. The operating device as claimed in claim 1, wherein the second circuit part (AV) includes a first-order RC low pass filter for forming mean values.

4. The operating device as claimed in claim 1, wherein the AC voltage generator (G) requires an auxiliary voltage (H) and/or a safety disconnection signal, and the safe state of the operating device is achieved by virtue of the fact that the auxiliary voltage (H) and/or the safety disconnection signal is/are deactivated by means of a controlled switch.

5. The operating device as claimed in claim 1, wherein the AC voltage generator requires an auxiliary voltage (H) and/or a safety disconnection signal, and the auxiliary voltage (H) and/or safety disconnection signal is/are conducted via at least one different filament.

6. The operating device as claimed in claim 1, wherein the first circuit part (SD) has a second input (EAC), and in that the AC voltage component of the voltage supplied by the AC voltage generator (G) is fed to the second input (EAC) of the first circuit part (SD) via at least one different filament (W1), the operating device being put into a safe state upon undershooting of the AC voltage level at the second input (EAC) of the first circuit part (SD) below a prescribed value.

7. The operating device as claimed in claim 1, wherein the charging of the capacitor (C7) can be performed simultaneously via a plurality of filaments (W1, W2) which are at different ends of a lamp, there being connected in each case to the filaments in each lead of said capacitor (C7) a diode (D22, D23) which are polarized such that they permit charging of said capacitor (C7).

8. The operating device as claimed in claim 6, wherein connected in series with the controlled switch (T4) is a further switch (T5), which opens upon undershooting of the AC voltage level at the second input (EAC) of the first circuit part (SD) below a prescribed value.

9. The operating device as claimed in claim 1, wherein only voltages at the input (EDC) of the first circuit part CSD) are evaluated which exceed a prescribed fraction of the supply voltage of the AC voltage generator (G).

* * * * *